US009249638B2

(12) United States Patent
Bernard

(10) Patent No.: US 9,249,638 B2
(45) Date of Patent: Feb. 2, 2016

(54) WELLBORE PRESSURE CONTROL WITH OPTIMIZED PRESSURE DRILLING

(75) Inventor: Christopher J. Bernard, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 902 days.

(21) Appl. No.: 13/423,384

(22) Filed: Mar. 19, 2012

(65) Prior Publication Data

US 2012/0255777 A1 Oct. 11, 2012

(30) Foreign Application Priority Data

Apr. 8, 2011 (WO) ..... PCT/US11/31790

(51) Int. Cl.

| | |
|---|---|
| ***E21B 21/08*** | (2006.01) |
| ***E21B 27/00*** | (2006.01) |
| ***E21B 34/00*** | (2006.01) |
| ***E21B 44/00*** | (2006.01) |
| ***E21B 21/10*** | (2006.01) |

(52) U.S. Cl.

CPC ..... *E21B 21/08* (2013.01); *E21B 21/10* (2013.01)

(58) Field of Classification Search

CPC ... E21B 21/08; E21B 2021/006; E21B 21/10; E21B 44/00

USPC ..... 175/25, 48

See application file for complete search history.

(56) References Cited

U.S. PATENT DOCUMENTS

| | | | | |
|---|---|---|---|---|
| 4,063,602 | A | | 12/1977 | Howell et al. |
| 4,194,567 | A | | 3/1980 | Marais |
| 4,468,056 | A | | 8/1984 | Kramer et al. |
| 4,626,135 | A | | 12/1986 | Roche |
| 4,813,495 | A | | 3/1989 | Leach |
| 4,880,060 | A | | 11/1989 | Schwendemann et al. |
| 5,370,187 | A | * | 12/1994 | Ferguson et al. ..... 166/308.1 |
| 5,771,971 | A | | 6/1998 | Horton et al. |
| 5,771,974 | A | | 6/1998 | Stewart et al. |
| 6,053,252 | A | | 4/2000 | Edwards |
| 6,065,550 | A | | 5/2000 | Gardes |
| 6,102,673 | A | | 8/2000 | Mott et al. |
| 6,138,774 | A | | 10/2000 | Bourgoyne et al. |
| 6,173,768 | B1 | | 1/2001 | Watson |
| 6,230,824 | B1 | | 5/2001 | Peterman et al. |
| 6,263,982 | B1 | | 7/2001 | Hannegan et al. |
| 6,273,193 | B1 | | 8/2001 | Hermann et al. |

(Continued)

FOREIGN PATENT DOCUMENTS

| | | |
|---|---|---|
| CN | 101424169 | 5/2009 |
| EP | 0289673 | 11/1988 |
| EP | 1936112 A2 | 9/2001 |
| EP | 1240404 B1 | 12/2003 |
| EP | 1071862 B1 | 11/2004 |

(Continued)

OTHER PUBLICATIONS

Office Action issued Mar. 14, 2012 for U.S. Appl. No. 12/299,411, 36 pages.

(Continued)

*Primary Examiner* — Daniel P Stephenson

(74) *Attorney, Agent, or Firm* — Chamberlain Hrdlicka

(57) ABSTRACT

A well system can include an accumulator in communication with a wellbore, whereby the accumulator applies pressure to the wellbore. A method of maintaining a desired pressure in a wellbore can include applying pressure to the wellbore from an accumulator in response to pressure in the wellbore being less than the desired pressure. Another well system can include a dampener in communication with a wellbore isolated from atmosphere, whereby the dampener mitigates pressure spikes in the wellbore.

21 Claims, 3 Drawing Sheets

(56) References Cited

U.S. PATENT DOCUMENTS 6,325,159 B1 12/2001 Peterman et al.
6,328,107 B1 12/2001 Maus
6,352,129 B1 3/2002 Best
6,421,298 B1 7/2002 Beattie et al.
6,450,262 B1 9/2002 Regan
6,454,022 B1 9/2002 Sangesland et al.
6,457,540 B2 10/2002 Gardes
6,470,975 B1 10/2002 Bourgoyne et al.
6,527,062 B2 3/2003 Elkins et al.
6,571,873 B2 6/2003 Maus
6,598,682 B2 7/2003 Johnson et al.
6,662,110 B1 12/2003 Barach et al.
6,668,943 B1 12/2003 Maus et al.
6,732,798 B2 5/2004 Johnson et al.
6,732,804 B2 5/2004 Hosie et al.
6,739,397 B2 5/2004 Ayling
6,745,857 B2 6/2004 Gjedebo
6,802,379 B2 10/2004 Dawson et al.
6,820,702 B2 11/2004 Niedermayr et al.
6,840,322 B2 1/2005 Haynes et al.
6,854,532 B2 2/2005 Fincher et al.
6,892,812 B2 5/2005 Niedermayr et al.
6,904,981 B2 6/2005 Van Riet
6,913,092 B2 7/2005 Bourgoyne et al.
6,920,085 B2 7/2005 Finke et al.
6,981,561 B2 1/2006 Krueger et al.
7,023,691 B1 4/2006 Feight et al.
7,032,691 B2 4/2006 Humphreys
7,044,237 B2 5/2006 Leuchtenberg
7,055,627 B2 6/2006 Fontana et al.
7,073,591 B2 7/2006 Massie et al.
7,080,685 B2 7/2006 Bailey et al.
7,093,662 B2 8/2006 DeBoer
7,096,975 B2 8/2006 Aronstam et al.
7,134,489 B2 11/2006 Van Riet
7,158,886 B2 1/2007 Hou et al.
7,159,669 B2 1/2007 Bourgoyne et al.
7,174,975 B2 2/2007 Krueger et al.
7,185,718 B2 3/2007 Gardes
7,185,719 B2 3/2007 Van Riet
7,201,231 B2 4/2007 Chaplin et al.
7,207,399 B2 4/2007 Duhe et al.
7,237,613 B2 7/2007 Radi et al.
7,237,623 B2 7/2007 Hannegan
7,258,171 B2 8/2007 Bourgoyne et al.
7,264,058 B2 9/2007 Fossli
7,270,185 B2 9/2007 Fontana et al.
7,278,496 B2 10/2007 Leuchtenberg
7,281,593 B2 10/2007 Steiner et al.
7,350,597 B2 4/2008 Reitsma et al.
7,353,887 B2 4/2008 Krueger et al.
7,363,974 B2 * 4/2008 Wang et al. ..... 166/278
7,367,410 B2 5/2008 Sangesland
7,367,411 B2 5/2008 Leuchtenberg
7,395,878 B2 7/2008 Reitsma et al.
7,497,266 B2 3/2009 Fossli
7,513,310 B2 4/2009 Fossli
7,562,723 B2 7/2009 Reitsma
7,650,950 B2 1/2010 Leuchtenberg
7,658,228 B2 2/2010 Moksvold
7,677,329 B2 3/2010 Stave
7,708,064 B2 5/2010 Sehsah
7,721,822 B2 5/2010 Krueger et al.
7,806,203 B2 10/2010 Krueger et al.
7,836,973 B2 * 11/2010 Belcher et al. ..... 175/25
7,913,774 B2 3/2011 Partouche
7,926,593 B2 4/2011 Bailey et al.
8,281,875 B2 * 10/2012 Lovorn et al. ..... 175/25
8,490,719 B2 * 7/2013 Duhe et al. ..... 175/57
8,727,018 B1 * 5/2014 McCulloch ..... 166/375
2002/0092655 A1 7/2002 Fincher et al.
2002/0108783 A1 8/2002 Elkins et al.
2002/0112888 A1 8/2002 Leuchtenberg
2002/0180613 A1 * 12/2002 Shi et al. ..... 340/853.1
2003/0034079 A1 * 2/2003 Lee ..... 138/31
2003/0066650 A1 4/2003 Fontana et al.
2003/0089498 A1 5/2003 Johnson et al.
2003/0098181 A1 5/2003 Aronstam et al.
2003/0111799 A1 6/2003 Gilmore
2003/0127230 A1 7/2003 Von Eberstein, Jr. et al.
2003/0139916 A1 7/2003 Choe et al.
2003/0170077 A1 9/2003 Herd et al.
2003/0220742 A1 11/2003 Niedermayr et al.
2003/0234120 A1 12/2003 Paluch et al.
2004/0040746 A1 3/2004 Niedermayr et al.
2004/0124008 A1 7/2004 Fincher et al.
2004/0178001 A1 9/2004 Bourgoyne et al.
2004/0178003 A1 * 9/2004 Riet ..... 175/57
2004/0206548 A1 10/2004 Arnostam et al.
2004/0231889 A1 * 11/2004 Van Riet ..... 175/57
2005/0061546 A1 3/2005 Hannegan
2005/0092522 A1 5/2005 Humphreys
2005/0092523 A1 5/2005 McCaskill et al.
2005/0098349 A1 5/2005 Krueger et al.
2006/0006004 A1 1/2006 Terry et al.
2006/0021755 A1 2/2006 Radi et al.
2006/0065402 A9 3/2006 Fontana et al.
2006/0070772 A1 4/2006 DeBoer
2006/0086538 A1 4/2006 Van Riet
2006/0102387 A1 5/2006 Bourgoyne et al.
2006/0124300 A1 6/2006 Steiner et al.
2006/0169491 A1 8/2006 Fossli
2006/0185857 A1 8/2006 York et al.
2006/0191716 A1 8/2006 Humphreys
2006/0207795 A1 9/2006 Kinder et al.
2007/0045006 A1 * 3/2007 Krueger et al. ..... 175/25
2007/0068704 A1 3/2007 Krueger et al.
2007/0168056 A1 7/2007 Shayegi et al.
2007/0240875 A1 10/2007 Van Riet
2007/0246263 A1 * 10/2007 Reitsma ..... 175/38
2007/0278007 A1 12/2007 Krueger et al.
2008/0029306 A1 * 2/2008 Krueger et al. ..... 175/210
2008/0041149 A1 2/2008 Leuchtenberg
2008/0060846 A1 3/2008 Belcher et al.
2008/0105434 A1 5/2008 Orbell et al.
2009/0139724 A1 6/2009 Gray et al.
2009/0159334 A1 6/2009 Alberty
2009/0211239 A1 8/2009 Askeland
2010/0018715 A1 1/2010 Orbell et al.
2010/0186960 A1 * 7/2010 Reitsma et al. ..... 166/305.1
2011/0139506 A1 6/2011 Lovorn et al.
2011/0290562 A1 12/2011 Standifird et al.
2012/0067594 A1 * 3/2012 Noske et al. ..... 166/373
2012/0165997 A1 6/2012 Lewis et al.
2012/0242920 A1 9/2012 Xu et al.
2012/0251407 A1 10/2012 Petela et al.
2012/0255776 A1 10/2012 Knudsen et al.
2012/0255777 A1 10/2012 Bernard
2013/0112404 A1 5/2013 Lovorn et al.

FOREIGN PATENT DOCUMENTS

EP 1356186 B1 6/2005
GB 2229787 A 10/1990
RU 2245984 2/2005
RU 2301319 5/2005
WO 9942696 A1 8/1999
WO 0165060 A1 9/2001
WO 0190528 A1 11/2001
WO 0250398 A1 6/2002
WO 03071091 8/2003
WO 2005042917 A1 5/2005
WO 2007008085 A1 1/2007
WO WO 2008051978 A1 * 5/2008 ..... E21B 21/08
WO 2009111412 A1 9/2009
WO 2010045064 4/2010
WO 2011043764 A1 4/2011

OTHER PUBLICATIONS

Office Action issued Feb. 7, 2012 for U.S. Appl. No. 13/022,964, 15 pages.
GE Oil & Gas; "Hydril Pressure Control K Pulsation Dampeners", company article, dated Aug. 6, 2010, 2 pages.

(56) References Cited

OTHER PUBLICATIONS

IRIS; "Automatic Coordination of Equipment While Circulating out a Kick and Displacing the Kill-Weight Mud," IADC Well Control Europe, dated 2010, 41 pages.
International Search Report with Written Opinion issued Feb. 8, 2012 for PCT Patent Application No. PCT/US11/031767, 9 pages.
International Search Report ad Written Opinion issued Sep. 22, 2008, for International Patent Application No. PCT/US07/83974, 16 pages.
International Search Report and Written Opinion issued Feb. 12, 2009, for International Patent Application No. PCT/US08/87686, 7 pages.
International Preliminary Report on Patentability issued May 22, 2009, for International Patent Application No. PCT/US07/83974, 13 pages.
Singapore Written Opinion issued May 17, 2010 for SG Patent Application No. 2009030222, 10 pages.
Pre-Interview First Office Action issued Jul. 14, 2010 for U.S. Appl. No. 11/936,411, 14 pages.
Pre-Interview First Office Action issued Jul. 29, 2010 for U.S. Appl. No. 11/936,411, 3 pages.
Singapore Office Action issued Feb. 15, 2011 for SG Patent Application No. 200903022, 9 pages.
Australian Examiner's Report issued Mar. 7, 2011 for AU Patent Application No. 2007317276, 2 pages.
International Search Report and Written Opinion issued Jun. 17, 2011 for PCT Patent Application No. PCT/US2010/056433, 9 pages.
International Search Report and Written Opinion issued Jul. 27, 2011 for PCT Patent Application No. PCT/US2010/062394, 10 pages.
Weatherford International Ltd.; "Weatherford Model 7800 Rotating Control Device", article No. 4593.00, dated 2007, 5 pages.
Weatherford International Ltd.; "Model 7875 Rotating Control Device", article No. 4594.01, dated 2010, 4 pages.
Hannegan, Don; Weatherford International; "Offshore Drilling Hazard Mitigation: Controlled Pressure Drilling Redefines What is Drillable", Managed Pressure Drilling Magazine, Drilling Contractor article, dated Jan.-Feb. 2009, 4 pages.
Smith Services; "Hold 2500 Rotating Control Device", product brochure, article No. ss-04-0055, dated 2004, 4 pages.
Smith Services; "Marine Riser RCD", product presentation, dated Jul. 2009, 18 pages.
Office Action issued Jan. 24, 2012 for U.S. Appl. No. 12/638,012, 18 pages.
International Search Report and Written Opinion issued Sep. 22, 2008, for International Patent Application No. PCT/US07/83974, 16 pages.
International Search Report with Written Opinion issued Jun. 17, 2011 for PCT Patent Application No. PCT/US10/056433, 9 pages.
Office Action issued Feb. 7, 2012 for U.S. Appl. No. 13/022,964, 15 page.
International Search Report with Written Opinion issued Dec. 21, 2011 for PCT Patent Application No. PCT/US11/031790, 15 pages.
International Search Report with Written Opinion issued Feb. 17, 2012 for PCT Patent Application No. PCT/US11/043750, 11 pages.
MI SWACO; "10k Super AutoChoke", product bulletin MS-04104, dated Aug. 2004, 4 pages.
IADC Well Control Europe; "Well Control in an Increasingly Complex and Changing Environment", Conference and Exhibition 2010, dated Apr. 13-14, 2010, 4 pages.
Chinese Office Action issued Feb. 22, 2012 for CN Patent Application No. 200780049409.0, 4 pages.
English Translation of Chinese Office Action issued Feb. 22, 2012 for CN Patent Application No. 200780049409.0, 7 pages.
International Preliminary Report on Patentability issued Feb. 9, 2012 for International Patent Application No. PCT/US09/052227, 7 pages.
Australian Office Action issued Oct. 5, 2010 for AU Patent Application No. 2007317276, 2 pages.
International Search Report with Written Opinion issued Oct. 13, 2010 for PCT Patent Application No. PCT/US10/020122, 13 pages.
International Search Report with Written Opinion issued Jan. 25, 2011 for PCT Patent Application No. PCT/US10/032578, 9 pages.
International Preliminary Report with Patentability issued Jun. 30, 2011 for PCT Patent Application No. PCT/US08/087686, 6 pages.
Office Action issued Sep. 16, 2011 for U.S. Appl. No. 12/299,411, 23 pages.
International Search Report with Written Opinion issued Nov. 21, 2011 for PCT Patent Application No. PCT/US11/036616, 13 pages.
Office Action issued Nov. 25, 2011 for U.S. Appl. No. 13/084,841, 19 pages.
International Search Report with Written Opinion issued Dec. 13, 2011 for PCT Patent Application No. PCT/US11/035751, 16 pages.
Singapore Examination Report issued Dec. 27, 2011 for SG Patent Application No. 200903022-2, 8 pages.
US 6,708,780, 03/2004, Bourgoyne et al. (withdrawn)

* cited by examiner

WELLBORE PRESSURE CONTROL WITH OPTIMIZED PRESSURE DRILLING

CROSS-REFERENCE TO RELATED APPLICATION

This application claims the benefit under 35 USC §119 of the filing date of International Application Serial No. PCT/US11/31790 filed 8 Apr. 2011. The entire disclosure of this prior application is incorporated herein by this reference.

BACKGROUND

The present disclosure relates generally to equipment utilized and operations performed in conjunction with a subterranean well and, in an embodiment described herein, more particularly provides for wellbore pressure control with optimized pressure drilling.

It is important in drilling operations to control wellbore pressure. Excessive wellbore pressure can cause undesired fracturing of an earth formation penetrated by a wellbore being drilled, breakdown of casing shoes, and loss of valuable drilling fluids. Insufficient wellbore pressure can cause formation fluids to flow into the wellbore, and can cause wellbore instability.

Therefore, it will be appreciated that improvements are continually needed in the art of wellbore pressure control.

DETAILED DESCRIPTION

Figure 1:
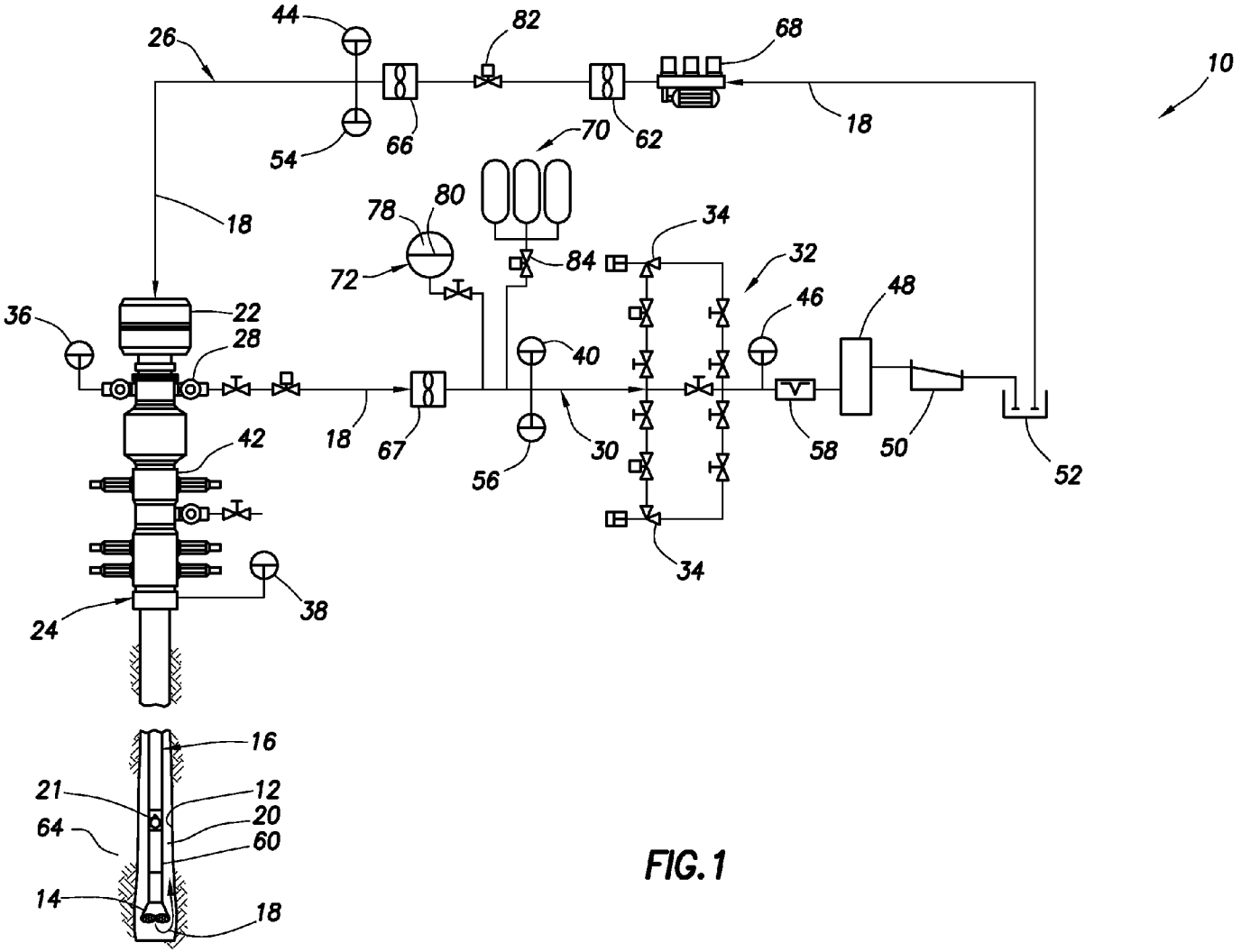
FIG. 1 is a representative partially cross-sectional view of a well system and associated method which can embody principles of this disclosure.

Representatively illustrated in FIG. 1 is a well system 10 and associated method which can embody principles of this disclosure. In the system 10, a wellbore 12 is drilled by rotating a drill bit 14 on an end of a tubular drill string 16. The drill bit 14 may be rotated by rotating the drill string 16 and/or by operating a mud motor (not shown) interconnected in the drill string.

Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of bottom hole pressure control. A non-return valve 21 (typically a flapper-type check valve) prevents flow of the drilling fluid 18 upward through the drill string 16.

Control of bottom hole pressure is very important in managed pressure and underbalanced drilling, and in other types of optimized pressure drilling operations. Preferably, the bottom hole pressure is optimized to prevent excessive loss of fluid into an earth formation 64 surrounding the wellbore 12, undesired fracturing of the formation, undesired influx of formation fluids into the wellbore, etc.

In typical managed pressure drilling, it is desired to maintain the bottom hole pressure just greater than a pore pressure of the formation 64, without exceeding a fracture pressure of the formation. In typical underbalanced drilling, it is desired to maintain the bottom hole pressure somewhat less than the pore pressure, thereby obtaining a controlled influx of fluid from the formation 64.

Nitrogen or another gas, or another lighter weight fluid, may be added to the drilling fluid 18 for pressure control. This technique is especially useful, for example, in underbalanced drilling operations, or in segregated density (such as dual gradient) managed pressure drilling.

In the system 10, additional control over the bottom hole pressure is obtained by closing off the annulus 20 (e.g., isolating it from communication with the atmosphere and enabling the annulus to be pressurized at or near the surface) using a rotating control device 22 (RCD). The RCD 22 seals about the drill string 16 above a wellhead 24. Although not shown in FIG. 1, the drill string 16 would extend upwardly through the RCD 22 for connection to, for example, a standpipe line 26 and/or other conventional drilling equipment.

The drilling fluid 18 exits the wellhead 24 via a wing valve 28 in communication with the annulus 20 below the RCD 22. The fluid 18 then flows through a fluid return line 30 to a choke manifold 32, which includes redundant chokes 34. Backpressure is applied to the annulus 20 by variably restricting flow of the fluid 18 through the operative choke(s) 34.

The greater the restriction to flow through the choke 34, the greater the backpressure applied to the annulus 20. Thus, bottom hole pressure can be conveniently regulated by varying the backpressure applied to the annulus 20. A hydraulics model can be used, as described more fully below, to determine a pressure applied to the annulus 20 at or near the surface, which pressure will result in a desired bottom hole pressure. In this manner, an operator (or an automated control system) can readily determine how to regulate the pressure applied to the annulus at or near the surface (which can be conveniently measured) in order to obtain the desired bottom hole pressure.

It can also be desirable to control pressure at other locations along the wellbore 12. For example, the pressure at a casing shoe, at a heel of a lateral wellbore, in generally vertical or horizontal portions of the wellbore 12, or at any other location can be controlled using the principles of this disclosure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the fluid return line 30 upstream of the choke manifold 32.

Another pressure sensor 44 senses pressure in the standpipe line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 66.

Not all of these sensors are necessary. For example, the system 10 could include only one of the flowmeters 62, 66. However, input from the sensors is useful to the hydraulics model in determining what the pressure applied to the annulus 20 should be during the drilling operation.

In addition, the drill string 16 may include its own sensors 60, for example, to directly measure bottom hole pressure. Such sensors 60 may be of the type known to those skilled in the art as pressure while drilling (PWD), measurement while drilling (MWD) and/or logging while drilling (LWD) sensor systems. These drill string sensor systems generally provide at least pressure measurement, and may also provide temperature measurement, detection of drill string 16 characteristics (such as vibration, weight on bit, stick-slip, etc.), formation characteristics (such as resistivity, density, etc.) and/or other measurements. Various forms of telemetry (acoustic, pressure pulse, electromagnetic, optical, wired, etc.) may be used to transmit the downhole sensor measurements to the surface. The drill string 16 could be provided with conductors, optical waveguides, etc., for transmission of data and/or commands between the sensors 60 and the process control system 74 described below (see FIG. 2).

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc.

Fewer sensors could be included in the system 10, if desired. For example, the output of the rig mud pump 68 could be determined by counting pump strokes, instead of by using the flowmeter 62 or any other flowmeter(s).

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the drill string 16 by the rig mud pump 68. The pump 68 receives the fluid 18 from the mud pit 52 and flows it to the standpipe line 26. The fluid 18 then circulates downward through the drill string 16, upward through the annulus 20, through the mud return line 30, through the choke manifold 32, and then via the separator 48 and shaker 50 to the mud pit 52 for conditioning and recirculation.

Note that, in the system 10 as so far described, the choke 34 cannot be used to control backpressure applied to the annulus 20 for control of the bottom hole pressure, unless the fluid 18 is flowing through the choke. In conventional overbalanced drilling operations, a lack of circulation can occur whenever a connection is made in the drill string 16 (e.g., to add another length of drill pipe to the drill string as the wellbore 12 is drilled deeper), and the lack of circulation will require that bottom hole pressure be regulated solely by the density of the fluid 18.

In the system 10, however, a desired pressure applied to the annulus 20 can be maintained, even though the fluid 18 does not circulate through the drill string 16 and annulus 20. Thus, pressure can still be applied to the annulus 20, without the fluid 18 necessarily flowing through the choke 34.

In the system 10 as depicted in FIG. 1, an accumulator 70 can be used to supply a flow of fluid to the return line 30 upstream of the choke manifold 32. In other examples, the accumulator 70 may be connected to the annulus 20 via the BOP stack 42, and in further examples the accumulator could be connected to the choke manifold 32.

The accumulator 70 can be used to maintain a desired pressure in the annulus 20, whether or not additional pressure sources (such as, a separate backpressure pump and/or the rig pump 68, etc.) are also used. Diversion of fluid 18 from the standpipe manifold (or otherwise from the rig pump 68) to the return line 30 is described in International Application Serial No. PCT/US08/87686, and in U.S. application Ser. No. 13/022,964. The use of a separate backpressure pump is described in International Application Serial No. PCT/US11/31767, filed Apr. 8, 2011.

The well system 10 can also (or alternatively) include a pressure dampener 72 connected to the return line 30 as depicted in FIG. 1. The dampener 72 could alternatively be connected to the annulus 20 via the BOP stack 42, o the dampener could be connected to the choke manifold 32.

The dampener 72 functions to dampen pressure spikes (positive or negative) which would otherwise be communicated to the annulus 20. Certain operations (such as recommencing drilling after making a connection in the drill string 16, the drill bit 14 penetrating different reservoir pressure regimes, variations in rig pump 68 output, etc.) can induce such pressure spikes in the wellbore 12. The dampener 72 mitigates pressure spikes, so that a relatively continuous desired wellbore pressure can be maintained.

Preferably, the dampener 72 includes a pressurized gas chamber 78 isolated from the fluid 18 by a flexible membrane 80 or a floating piston, etc. Compressible gas in the chamber 78 provides a "cushion" to dampen any pressure spikes. However, other types of dampeners may be used, in keeping with the principles of this disclosure.

If desired, the dampener 72 could be provided with sufficient volume that it also operates as an accumulator, suitable for supplying pressure to maintain the desired wellbore pressure, as described above for the accumulator 70. In that case, the separate accumulator 70 may not be used.

At this point it should be pointed out that the well system 10 is described here as merely one example of a well system which can embody principles of this disclosure. Thus, those principles are not limited at all to the details of the well system 10 as depicted in FIG. 1 or described herein.

Figure 2:
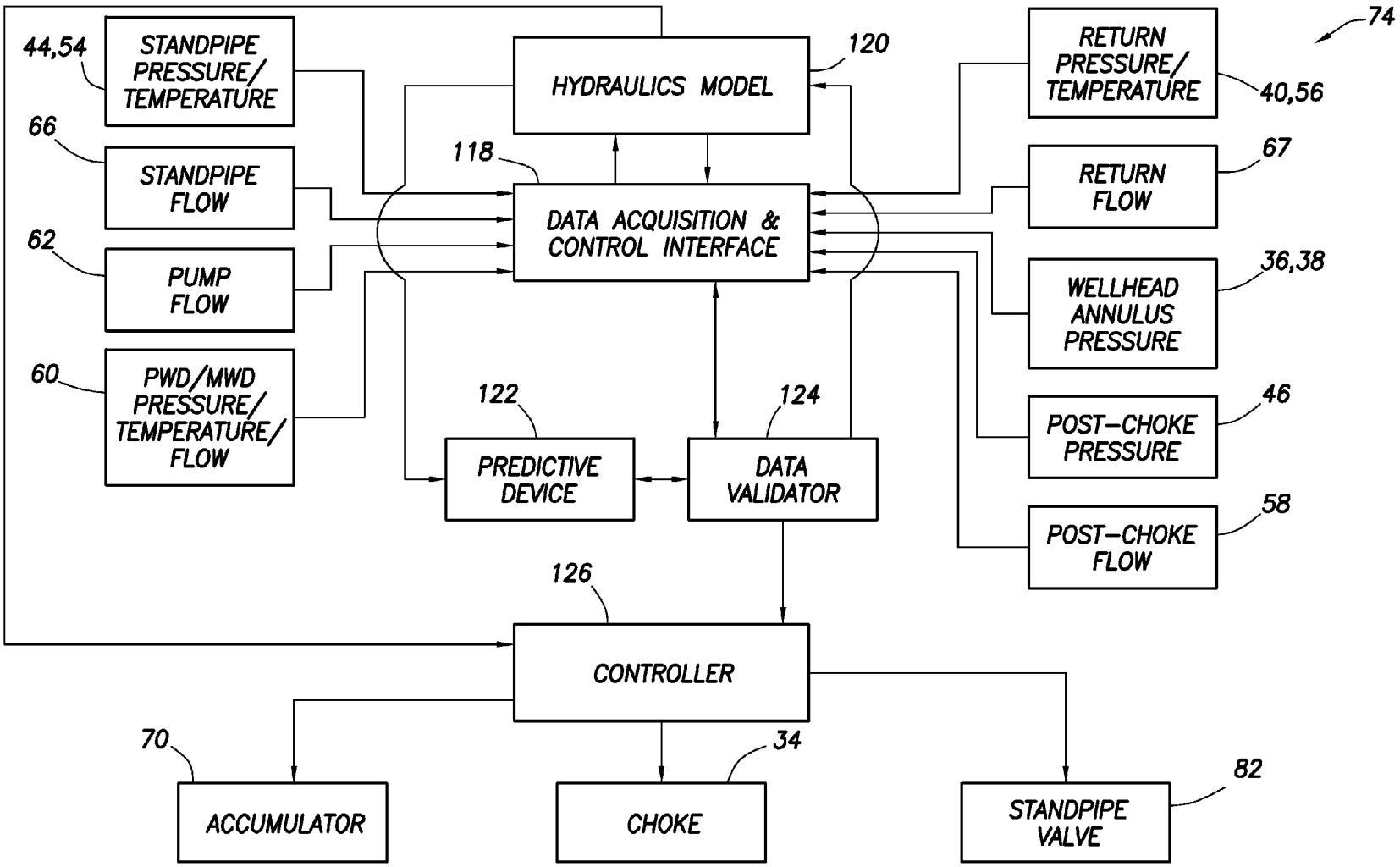
FIG. 2 is a representative block diagram of a process control system which may be used with the well system and method of FIG. 1, and which can embody principles of this disclosure.

Referring additionally now to FIG. 2, a block diagram of one example of a process control system 74 is representatively illustrated. The process control system 74 is described here as being used with the well system 10 of FIG. 1, but it should be understood that the process control system could be used with other well systems, in keeping with the principles of this disclosure. In other examples, the process control system 74 could include other numbers, types, combinations, etc., of elements, and any of the elements could be positioned at different locations or integrated with another element, in keeping with the scope of this disclosure.

As depicted in FIG. 2, the process control system 74 includes a data acquisition and control interface 118, a hydraulics model 120, a predictive device 122, a data validator 124 and a controller 126. These elements may be similar to those described in International Application Serial No. PCT/US10/56433 filed on 12 Nov. 2010.

The hydraulics model 120 is used to determine a desired pressure in the annulus 20 to thereby achieve a desired pressure at a certain location in the wellbore 12. The hydraulics model 120, using data such as wellbore depth, drill string rpm, running speed, mud type, etc., models the wellbore 12, the drill string 16, flow of the fluid through the drill string and annulus 20 (including equivalent circulating density due to such flow), etc.

The data acquisition and control interface 118 receives data from the various sensors 36, 38, 40, 44, 46, 54, 56, 58, 60, 62, 66, 67, together with rig and downhole data, and relays this data to the hydraulics model 120 and the data validator 124. In addition, the interface 118 relays the desired annulus pressure from the hydraulics model 120 to the data validator 124.

The predictive device 122 can be included in this example to determine, based on past data, what sensor data should currently be received and what the desired annulus pressure should be. The predictive device 122 could comprise a neural network, a genetic algorithm, fuzzy logic, etc., or any combination of predictive elements, to produce predictions of the sensor data and desired annulus pressure.

The data validator 124 uses these predictions to determine whether any particular sensor data is valid, whether the desired annulus pressure output by the hydraulics model 120 is appropriate, etc. If it is appropriate, the data validator 124 transmits the desired annulus pressure to the controller 126 (such as a programmable logic controller, which may comprise a proportional integral derivative (PID) controller), which controls operation of the choke 34, the accumulator 70 and various flow control devices (such as, a valve 82 of the standpipe manifold, etc.).

In this manner, the choke 60, accumulator 70 and various flow control devices (such as, the standpipe valve 82, etc.) can be automatically controlled to achieve and maintain the desired pressure in the annulus 20. Actual pressure in the annulus 20 is typically measured at or near the wellhead 24 (for example, using sensors 36, 38, 40), which may be at a land or subsea location.

For example, if there is no circulation of the fluid 18 through the drill string 16 and annulus 20, and pressure in the wellbore 12 falls below the desired pressure setpoint, a valve 84 of the accumulator 70 can be opened by the controller 126 to supply the requisite pressure to the annulus, so that the desired pressure is maintained in the annulus and the remainder of the wellbore 12. This situation could occur, for example, when making connections in the drill string 16, when tripping the drill string into or out of the wellbore 12, if there is a malfunction of the rig pump 68, etc.

Figure 3:
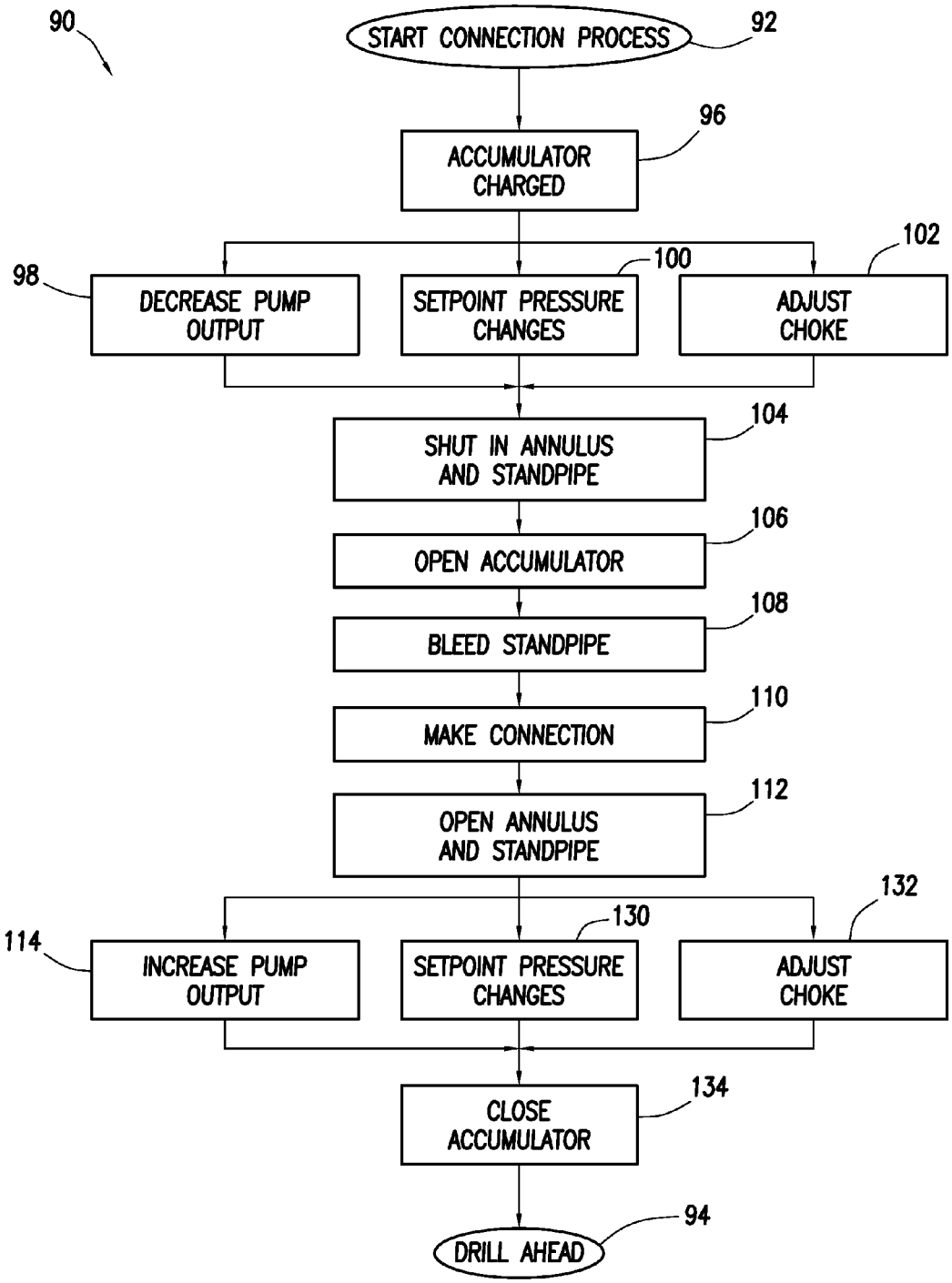
FIG. 3 is a representative flowchart for a method which may be used with the well system, and which can embody principles of this disclosure.

Referring additionally now to FIG. 3, a method 90 of maintaining a desired pressure in the wellbore 12 is representatively illustrated in flowchart form. The method 90 may be used with the well system 10 of FIG. 1, or it may be used with other well systems without departing from the principles of this disclosure.

The method 90 as depicted in FIG. 3 is used for when a connection is made in the drill string 16, but it will be appreciated that the method, with appropriate modifications, can be used when tripping the drill string into or out of the wellbore 12, when another pressure source is otherwise not available to supply pressure to the wellbore, etc.

The method 90 example of FIG. 3 begins with a starting step 92 and ends at step 94 with drilling ahead. Although not shown in FIG. 3, throughout the method 90 the hydraulics model 120 continues to output a desired pressure setpoint, and if fluid 18 flows through the choke 34, the choke is operated as needed to maintain the desired pressure in the wellbore. However, in a portion of the method 90, there is no flow through the choke 34, and so the controller 126 will maintain the choke closed in that portion of the method, as described more fully below.

In step 96, the accumulator 70 is charged (e.g., pressurized). The accumulator 70 may be charged before or after the method 90 begins. Preferably, the accumulator 70 is maintained in a charged state throughout the optimized pressure drilling operation, and is charged prior to starting the method 90, but step 96 is included in the method to indicate that, at this point, the accumulator should be in a charged state.

In preparation for making the connection in the drill string 16, the output of the rig pump 68 is gradually decreased (step 98), the desired pressure setpoint output by the hydraulics model 120 changes (step 100), and the choke 34 is adjusted accordingly (step 102). These steps 98, 100, 102 are depicted in FIG. 3 as being performed in parallel, because each one depends on the others, and the steps can be performed simultaneously.

For example, as the rig pump 68 output decreases, equivalent circulating density also decreases, due to reduced flow of the fluid 18 through the wellbore 12. This situation is detected by various sensors, and is input to the hydraulics model 120, which updates the desired wellbore pressure setpoint accordingly. The choke 34 is adjusted as needed to maintain the updated desired pressure in the wellbore.

Eventually, flow from the rig pump 68 ceases, and the choke 34 is fully closed. The standpipe valve 82 is also closed to thereby trap the desired pressure in the wellbore 12 (step 104).

In step 106, the accumulator valve 84 is opened, so that the accumulator 70 can supply pressure to the annulus 20, if needed. Alternatively, the accumulator valve 84 could be opened only when and if pressure in the wellbore 12 falls below the desired pressure setpoint.

In step 108, pressure in the standpipe 26 is bled off in preparation for disconnecting a kelly or top drive, etc. A standpipe 26 bleed valve (not shown) is used for this purpose in conventional drilling operations.

In step 110, the connection is made in the drill string 16. This step 110 could comprise threading a stand of drill pipe to the drill string 16 after disconnecting the kelly or top drive, etc. After the connection is made, the kelly or top drive, etc. is reconnected to the drill string 16, and the standpipe 26 bleed valve is closed.

In step 112, the standpipe valve 82 is opened, and the choke 34 is opened, to thereby reestablish circulation through the drill string 16 and annulus 20. This step is preferably performed gradually to minimize pressure spikes, for example, by slowly filling the added drill pipe stand and the standpipe 26 with the fluid 18 from the rig pump 68. Any resulting pressure spikes can be mitigated by the dampener 72.

In steps 114, 130, 132, the output of the rig pump 68 is gradually increased, the setpoint pressure output by the hydraulics model 120 is updated, and the choke 34 is adjusted as needed to maintain the updated desired pressure in the wellbore 12. These steps are similar to the steps 98, 100, 102 described above, except in reverse (e.g., the output of the pump 68 is increased in step 114, instead of being decreased as in step 98).

When circulation of the fluid 18 through the drill string 16 and annulus 20 has been reestablished (steps 112, 114, 130, 132), the accumulator valve 84 can be closed (step 134), since at that point the choke 34 can be used to maintain the desired pressure in the wellbore 12. However, in other examples it may be desired to leave the accumulator 70 available to apply pressure the wellbore before and/or after the method 90 is performed.

Although FIG. 3 indicates that the accumulator valve 84 is opened at a particular point in the method 90 (step 106), and is closed at a particular point in the method (step 134), it should be clearly understood that the accumulator 70 may only supply pressure to the annulus 20 when and if pressure in the wellbore 12 falls below the desired pressure setpoint. The controller 126 could automatically control operation of the accumulator valve 84 (or another type of flow control device, e.g., a pressure regulator, etc.), so that pressure is supplied from the accumulator 70 to the wellbore 12 only when needed.

It may now be fully appreciated that the above disclosure provides significant advancements to the art of wellbore pressure control for optimized pressure drilling operations. The accumulator 70 can provide for application of pressure to the annulus 20, for example, when the fluid 18 is not flowing through the choke 34. The dampener 72 can be used to mitigate pressure spikes during the drilling operation and, if provided with sufficient volume, can serve as an accumulator itself.

The above disclosure provides to the art a well system 10. The well system 10 can include an accumulator 70 in communication with a wellbore 12, whereby the accumulator 70 applies pressure to the wellbore 12.

The wellbore 12 may be isolated from atmosphere by a rotating control device 22.

The well system 10 may also include a hydraulics model 120 which outputs a desired wellbore pressure. The accumulator 70 can apply pressure to the wellbore 12 in response to actual wellbore pressure being less than the desired wellbore pressure.

The accumulator 70 may be in communication with an annulus 20 formed between a drill string 16 and the wellbore 12. The accumulator 70 can be connected to a fluid return line 30 between a blowout preventer stack 42 and a choke manifold 32.

The well system 10 can include a choke 34 which variably restricts flow of fluid 18 from the wellbore 12, with the accumulator 70 applying pressure to the wellbore 12 in an absence of flow of the fluid 18 through the choke 34.

The well system 10 can also include a dampener 72 in communication with the wellbore 12.

The above disclosure also describes a method 90 of maintaining a desired pressure in a wellbore 12. The method 90 can include applying pressure to the wellbore 12 from an accumulator 70 in response to pressure in the wellbore 12 being less than the desired pressure.

Applying pressure may be performed concurrently with an absence of fluid 18 flow through a choke 34 which variably restricts flow of the fluid 18 from the wellbore 12.

The method 90 can also include providing communication between the wellbore 12 and a dampener 72.

The method 90 can include isolating the wellbore 12 from atmosphere with a rotating control device 22.

The method 90 can include outputting the desired pressure from a hydraulics model 120.

The method 90 can include providing communication between the accumulator 70 and an annulus 20 formed between a drill string 16 and the wellbore 12.

The method 90 can include performing the applying pressure while making or breaking a connection in a drill string 16.

Applying pressure may be performed in absence of fluid 18 circulating through a drill string 16 and an annulus 20 formed between the drill string 16 and the wellbore 12.

Also described above is a well system 10 which can include a dampener 72 in communication with a wellbore 12 isolated from atmosphere. The dampener 72 mitigates pressure spikes in the wellbore 12.

The wellbore 12 may be isolated from atmosphere by a rotating control device 22.

The dampener 72 may be in communication with an annulus 20 formed between a drill string 16 and the wellbore 12.

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well system, comprising:

an accumulator in communication with a wellbore, whereby the accumulator applies pressure to the wellbore, wherein the accumulator is connected to a fluid return line between a blowout preventer stack and a choke manifold.

2. The well system of claim 1, wherein the wellbore is isolated from atmosphere by a rotating control device.

3. The well system of claim 1, further comprising a hydraulics model which outputs a desired wellbore pressure, and wherein the accumulator applies pressure to the wellbore in response to actual wellbore pressure being less than the desired wellbore pressure.

4. The well system of claim 1, wherein the accumulator is in communication with an annulus formed between a drill string and the wellbore.

5. The well system of claim 1, further comprising a choke which variably restricts flow of fluid from the wellbore, and wherein the accumulator applies pressure to the wellbore in an absence of flow of the fluid through the choke.

6. The well system of claim 1, further comprising a dampener in communication with the wellbore.

7. A method of maintaining a desired pressure in a wellbore, the method comprising:

providing an accumulator connected to a fluid return line between a blowout preventer stack and a choke manifold; and applying pressure to the wellbore from the accumulator in response to pressure in the wellbore being less than the desired pressure.

8. The method of claim 7, wherein applying pressure is performed concurrently with an absence of fluid flow through a choke which variably restricts flow of the fluid from the wellbore.

9. The method of claim 7, further comprising providing communication between the wellbore and a dampener.

10. The method of claim 7, further comprising isolating the wellbore from atmosphere with a rotating control device.

11. The method of claim 7, further comprising outputting the desired pressure from a hydraulics model.

12. The method of claim 7, further comprising providing communication between the accumulator and an annulus formed between a drill string and the wellbore.

13. The method of claim 7, further comprising performing the applying pressure while making a connection in a drill string.

14. The method of claim 7, further comprising performing the applying pressure while breaking a connection in a drill string.

15. The method of claim 7, wherein applying pressure is performed in an absence of fluid circulating through a drill string and an annulus formed between the drill string and the wellbore.

16. A well system, comprising:

a dampener in communication with a wellbore isolated from atmosphere, whereby the dampener mitigates pressure spikes in the wellbore; and an accumulator connected to a fluid return line between a blowout preventer stack and a choke manifold, the accumulator being in communication with and configured to apply pressure to the wellbore.

17. The well system of claim 16, wherein the wellbore is isolated from atmosphere by a rotating control device.

18. The well system of claim 16, wherein the dampener is in communication with an annulus formed between a drill string and the wellbore.

19. The well system of claim 16, further comprising an accumulator in communication with the wellbore, whereby the accumulator applies pressure to the wellbore.

20. The well system of claim 19, further comprising a hydraulics model which outputs a desired wellbore pressure, and wherein the accumulator applies pressure to the wellbore in response to actual wellbore pressure being less than the desired wellbore pressure.

21. The well system of claim 19, further comprising a choke which variably restricts flow of fluid from the wellbore, and wherein the accumulator applies pressure to the wellbore in an absence of flow of the fluid through the choke.

* * * * *